United States Patent [19]

Scott

[11] 4,413,949

[45] Nov. 8, 1983

[54] ROTOR BLADE FOR GAS TURBINE ENGINES

[75] Inventor: Alexander Scott, Bristol, England

[73] Assignee: Rolls Royce (1971) Limited, London, England

[21] Appl. No.: 618,688

[22] Filed: Sep. 30, 1975

[30] Foreign Application Priority Data

Oct. 17, 1974 [GB] United Kingdom ..... 44948/74

[51] Int. Cl.[3] ..... F01D 5/18

[52] U.S. Cl. ..... 416/96 A; 416/97 R

[58] Field of Search ..... 416/90, 90 R, 90 A, 416/95, 96, 96 A, 97

[56] References Cited

U.S. PATENT DOCUMENTS 2,780,435 2/1957 Jackson ..... 416/90

2,873,944 2/1959 Wiese et al. ..... 416/96 A

*Primary Examiner*—Richard E. Schafer

*Assistant Examiner*—Maureen T. Ryan

*Attorney, Agent, or Firm*—Parkhurst & Oliff

[57] ABSTRACT

A turbine blade for a gas turbine engine has a hollow aerofoil and a root. A first insert for the distribution of cooling air in the aerofoil is inserted thereinto through an opening in the root but due to the relatively high camber of the blade the insert is such that it has to be displaced laterally after insertion. A second insert, also inserted through the opening, is provided to secure the first insert in position and to guide the cooling air from the opening to the first insert.

7 Claims, 6 Drawing Figures

ROTOR BLADE FOR GAS TURBINE ENGINES

This invention relates to a rotor blade for gas turbine engines.

Where the aerofoils of such blades are hollow and are provided with an insert for controlling the distribution of cooling air in the interior of the aerofoil, it is usually desirable to provide for the introduction of the insert through an opening at the radially inner end of the aerofoil. The opening extends through a part of the blade known as the "root", being the part whereby the aerofoil is secured to a rotor body or disc. In cases where the aerofoil is of a shape not well aligned with the root there is a difficulty in providing for the introduction of an insert through said opening. It is an object of this invention to reduce or overcome this difficulty.

According to this invention there is provided a rotor blade for gas turbine engines comprising a hollow aerofoil, a first hollow insert situated between opposite first and second interior surfaces of the aerofoil in an operative position in which the insert is in closer proximity with the second than the first surface, a root having an opening including opposite first and second surfaces which are spaced apart by a distance greater than the width of the first insert but less than the spacing between surfaces of said interior, the second surface of said interior being recessed in respect of the second surface of the opening and the first surface of said interior not being so recessed, a second hollow insert situated in an operative position between the first insert and the first surface of the aerofoil portion, the first insert being insertable through the opening and being displaceable laterally into said operative position thereof and the second insert being insertable after said lateral displacement of the first insert, and passage means for introducing cooling air into the interior of the inserts.

An example of a rotor blade according to the invention will now be described with reference to the accompanying drawings wherein.

Figure 1:
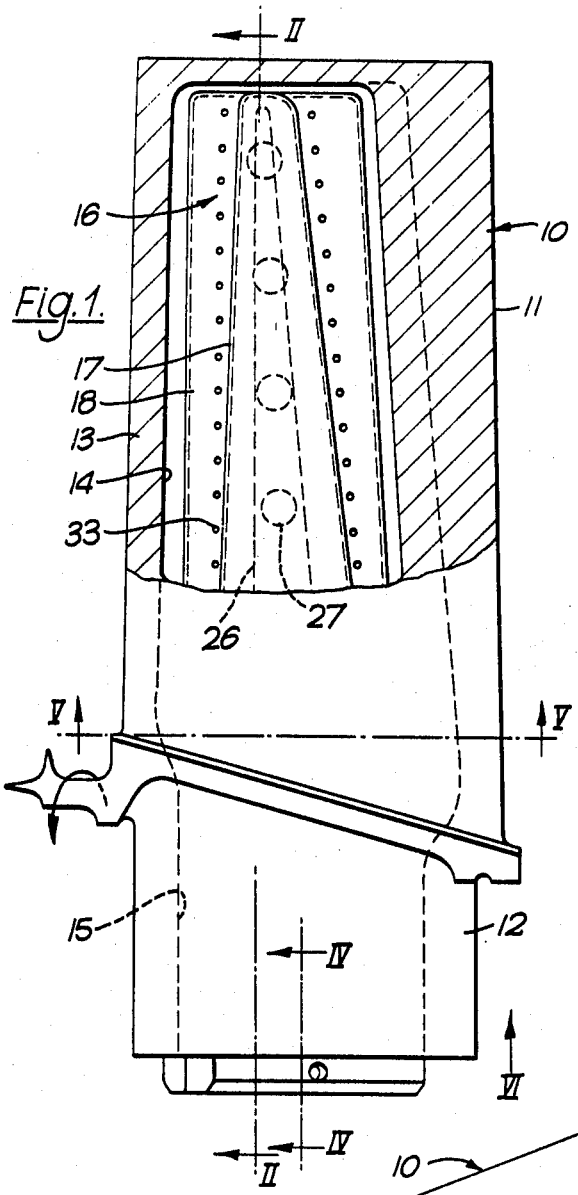
FIG. 1 is a partly sectioned elevation of the blade.
Figure 3:
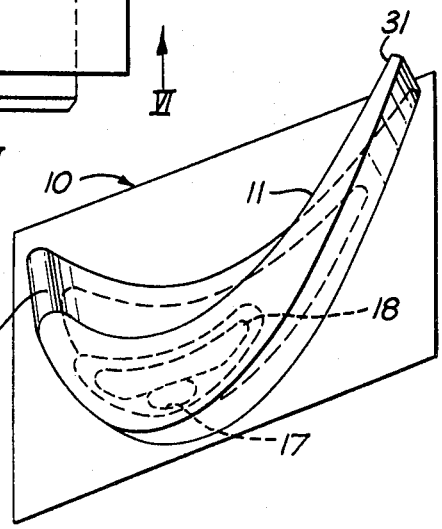
FIG. 3 is a plan view of FIG. 1.

The blade, generally denoted 10, comprises an aerofoil 11 integral with a root 12. The root 12 includes a "fir-tree" portion to facilitate its attachment to a turbine disc 30 of a gas turbine engine.

The aerofoil 11 is hollow and defined by a wall 13 of substantially constant cross-section so that the interior 14 of the aerofoil substantially follows the aerofoil cross-section of the exterior. The interior 14 has confronting first and second surfaces 14A,14B situated respectively at the high and low pressure sides of the aerofoil. Between the sufaces 14A,14B is arranged an assembly 16 of two inserts 17,18. The root has an opening 15 providing access to the interior 14 and having confronting first and second surfaces 15A,15B.

Figure 5:
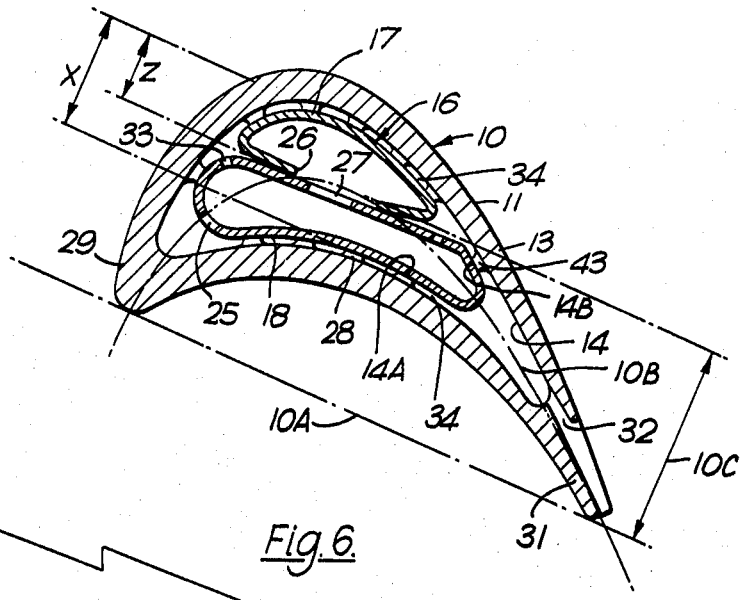
FIG. 5 is an enlarged section on the line V—V in FIG. 1.
Figure 6:
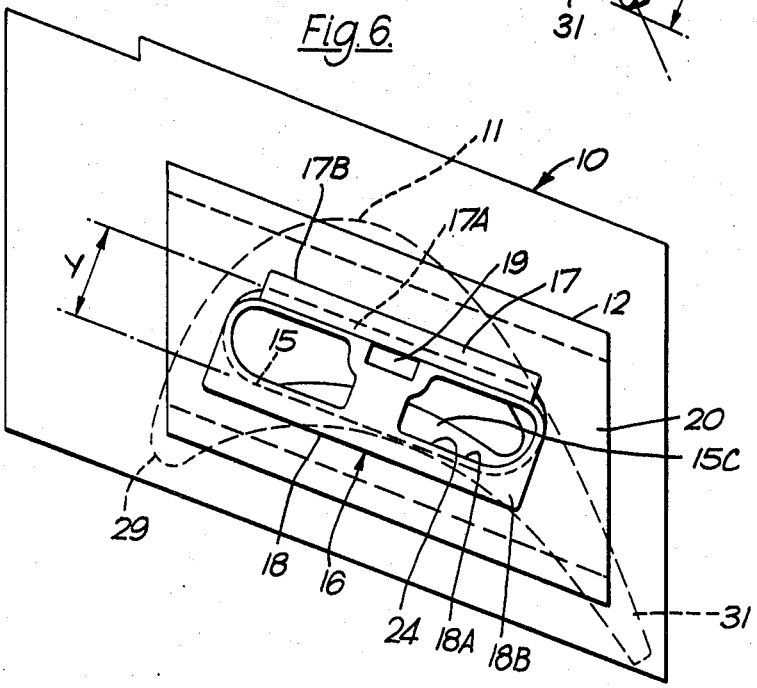
FIG. 6 is a view on the arrow VI in FIG. 1.

Referring particularly to FIGS. 5 and 6, the need for more than one insert is explained as follows. The aerofoil and the root are each of generally elongate cross-section, the direction of elongation of both aerofoil and root being given by the chord line 10A. However, whereas the root is more nearly straight in the direction of the line 10A the aerofoil follows a camber line 10B.

In cases, as in the present, where the camber, denoted 10C, is high, so that the aerofoil is almost of "U" cross-section, the leading and trailing edges 29,31 of the aerofoil extend beyond the root with the result that the overall spacing X between the sufaces 14A,14B is greater than the spacing Y between the surfaces 15A,15B. More specifically, the surface 14B is significantly recessed as at 14C in respect of the surface 15B whereas the surface 14A is not so recessed and, if anything, projects slightly across the surface 15A as at 15C. Such a situation is unavoidable if the root is not to be made unduly wide which is undesirable for reasons of weight. The relatively greater width of the interior 14 and especially the recession of the surface 14B made it impossible to provide a single insert capable of substantially filling the interior 14 and capable of being introduced through the opening 15. The provision of two separate inserts solves this problem.

Figure 2:
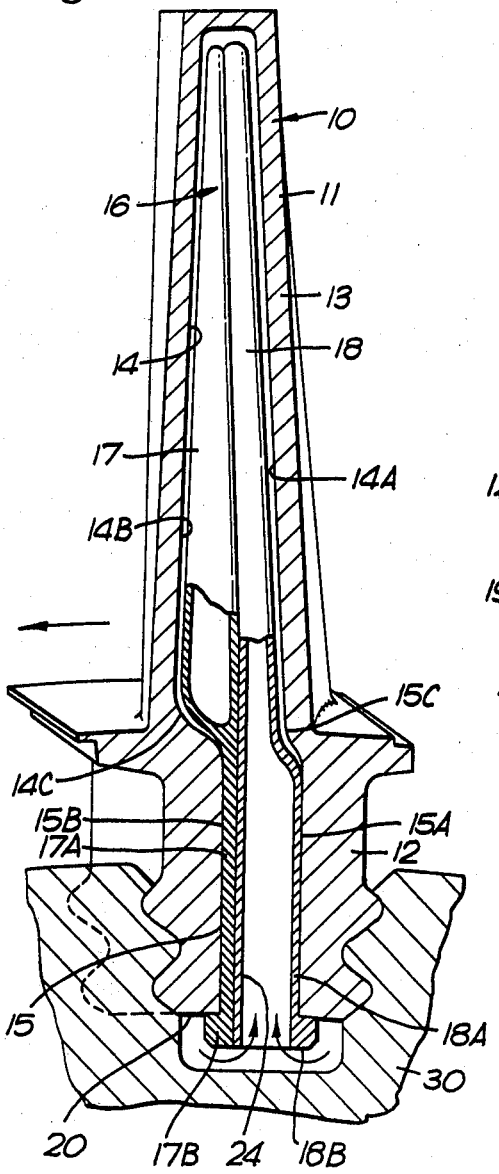
FIG. 2 is a section on the line II—II in FIG. 1.

The first insert 17 is made of a width Z (FIG. 5) only slightly less than the width Y (FIG. 6) of the opening 15 and after having been inserted into the interior 14 the insert 17 is moved laterally into the operative position shown in FIG. 2. Thereafter the second insert 18 is inserted through the opening 15 to fill the space necessarily left between the insert 17 and the surface 14A.

Figure 4:
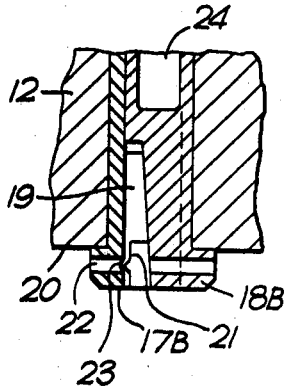
FIG. 4 is a section on the line IV—IV in FIG. 1.

The insert 17 is retained in its spanwise position by a neck 17A (FIGS. 2 and 6) extending through the opening 15 and terminating in a transverse lug 17B engaging a surface 20 of the root facing away from the aerofoil. The insert 18 has a corresponding neck 18A and lug 18B. The lugs 17B,18B secure the inserts against centrifugal force and the inserts are further secured by a wedge 19 (FIGS. 4 and 6) which urges the necks apart against the respective surfaces 15A,15B. The wedge itself is held in position by a dimple 23 formed in a relatively thin portion 21 of the wedge and engaging a hole 22 in one of the necks.

It will be noted that the neck 17A is relatively thin (FIG. 2), this being necessary to allow the lateral displacement of the insert 17 into the operative position. Contrary to this the neck 18A can be substantially wider. This aspect is used in connection with the introduction of the cooling air into the inserts. As will be seen, it is the insert 18 which is primarily responsible for the distribution of cooling air in the interior 14, especially to the leading edge of the aerofoil and the relatively great width of the neck 18A provides the room necessary for an air passage 24 (FIGS. 2 and 6) for guiding the air into the interior 14. To transfer the air to the insert 17, the insert has an opening 26 (FIGS. 1 and 5) communicating with holes 27 in the insert 17.

The insert 17 is C-shaped in cross-section (FIG. 5), the opening 26 being formed between the free extremities of the 'C'. By virtue of the C-shape, the insert has resilience and it is dimensioned to be in a state of compression between the insert 18 and the surface 14B thereby to ensure firm positioning of the insert and a tendency to inhibit vibration of the blade.

Projections 28 are provided on the wall 13 to space the inserts from the body of the wall and provide a substantially uniform spacing between the inserts and the walls. The surfaces 14A,14B are constituted by the free ends of the projections 28.

The insert 18 includes holes 25 in a portion adjacent the leading edge 29 of the aerofoil, the holes being arranged so that a flow of cooling air therefrom impinges on the inner surface of the leading edge 29 and subsequently flows through gaps 34 between the inserts 17 and 18 and the wall 13 before being exhausted through holes 32 provided in the trailing edge 31. Further holes 33 are provided in the insert 18 between the leading and trailing edges 29,31 so that regions of the aerofoil 11 which tend to get hotter than others are adequately cooled and also to ensure that the flow of cooling air from the leading edge to the trailing edge is maintained.

In the embodiment described, it is not necessary to provide outlet holes for cooling air in the insert 18 at the portion thereof adjacent the trailing edge 31 or in the insert 17 but such outlets may be provided if required.

Although the present invention has been described with reference to an insert assembly comprising two separable inserts, it will be appreciated that the assembly may comprise three or more inserts, the exact number being dependent on the configuration of the aerofoil in which the assembly is utilised.

Reference numerals given in the appended claims are for ease of identification of the basis of the claims in the specification and are not intended as in any way limiting the scope of the claims.

I claim:

1. Rotor blade for gas turbine engines comprising a hollow aerofoil (11), a first hollow insert (17) situated between opposite first and second interior surfaces (14A, 14B) of the aerofoil in an operative position in which the insert is in closer proximity with the second (14B) than the first (14A) surface, a root (12) having an opening (15) including opposite first and second surfaces (15A, 15B) which are spaced apart by a distance greater than the width of the first insert but less than the spacing between surfaces of said interior, the second surface (14B) of said interior defining a recess (14C) in respect of the second surface (15B) of the opening, a second hollow insert (18) situated in an operative position between the first insert (17) being insertable through the opening (15), the first insert being displaceable laterally into said recess to attain said operative position thereof and the second insert (18) being insertable after said lateral displacement of the first insert, and passage means (24) for introducing cooling air into the interior of the inserts.

2. A rotor blade according to claim 1, the second insert (18) including an inlet passage (24) for cooling air and an opening (26) for the transfer of cooling air to the first insert (17).

3. A rotor blade according to claim 1, the inserts (17,18) each including a neck (17A,18A) extending within the opening (15) of the root (12) when the inserts are in said operative positions, and means for securing said necks to the root.

4. A rotor blade according to claim 1, the second insert (18) being situated adjacent the high pressure side of the blade and having leading and trailing edge portions situated in proximity with the leading and trailing edges (29,31) of the blade, at least the leading edge portion of the second insert having outlet holes (25) for the cooling air, the second insert (18) being situated between the first insert (17) and the low pressure side of the blade and extending short of the leading and trailing edges (29,31) of the blade.

5. A rotor blade according to claim 2, the second insert (18) having a neck (18A) extending within said opening (15) and including a passage (24) for passing cooling air to the interior of the insert, the first insert (17) having a neck lying in said opening (15) adjacent the neck of the first insert, each said neck being provided with means (19) for being secured to said root portion (12).

6. A rotor blade according to claim 3, the root portion (12) having an end surface (20) facing away from the aerofoil (11), at least one of said necks (17A,18A) having a transverse extension (17B,18B) engaging the said end surface to retain the insert against movement in the direction of insertion beyond said operative position.

7. A rotor blade according to claim 6, including a wedge (19) inserted between said necks (17A,18A) to urge said necks into firm engagement with the opposite sides (15B,15A) of the opening.

* * * * *